United States Patent [19]

Morales

[11] Patent Number: 4,995,823

[45] Date of Patent: Feb. 26, 1991

[54] LIGHTING STRING

[75] Inventor: Rendell A. Morales, RZ Arnhem, Netherlands

[73] Assignee: Chainlight International S.A., Luxembourg, Luxembourg

[21] Appl. No.: 310,993

[22] Filed: Feb. 16, 1989

[30] Foreign Application Priority Data

Feb. 18, 1988 [NL] Netherlands ..... 8800417
Oct. 31, 1988 [NL] Netherlands ..... 8802658

[51] Int. Cl.[5] ..... H01R 4/24

[52] U.S. Cl. ..... 439/226; 439/404; 439/505; 439/612

[58] Field of Search ..... 439/612, 404, 623, 624, 439/417, 235, 226, 505, 405

[56] References Cited

U.S. PATENT DOCUMENTS

| | | | |
|---|---|---|---|
| 2,636,069 | 4/1953 | Gilbert | 439/417 |
| 3,447,253 | 6/1969 | Coad | 40/130 |
| 4,511,200 | 4/1985 | Belokin, Jr. | 439/235 |
| 4,521,838 | 6/1985 | Agabekov | 439/235 |
| 4,521,839 | 6/1985 | Cook | 362/234 |
| 4,525,019 | 6/1985 | Brasky | 339/98 |
| 4,569,568 | 2/1986 | Agabekov | 439/235 |

FOREIGN PATENT DOCUMENTS

| | | |
|---|---|---|
| 72831 | 12/1974 | Taiwan . |
| 5100 | of 1909 | United Kingdom . |
| 245109 | 7/1926 | United Kingdom . |

*Primary Examiner*—Gary F. Paumen
*Attorney, Agent, or Firm*—Finnegan, Henderson, Farabow, Garrett & Dunner

[57] ABSTRACT

Lighting string having two electrical wires, a number of mounting blocks spaced from each other along the electrical wires for accommodating respective parts of the electrical wires, and in each mounting block two terminal plates for electrically contacting the electrical wires and for accommodating a tubular electric lamp. The lighting string may be made by first placing the mounting blocks over the electrical wires and then placing the terminal plates in the mounting blocks, as result of which contact with the electrical wires is effected. Also the mounting blocks may be formed around the terminal plates. Then the lighting string is produced by proceeding on an electrical cable, in which the electrical wires are incorporated and providing the mounting blocks having integrated terminal plates on the electrical cable. The lighting string may be used in lighting devices and in display devices, such as advertising letter boxes.

19 Claims, 5 Drawing Sheets

LIGHTING STRING

BACKGROUND OF THE INVENTION

The invention relates to a lighting string comprising two insulated electrical wires extending substantially parallel to and spaced from each other, and a number of pairs of terminals, spaced from each other along the electrical wires, which are adapted to make a cut in the insulation of one of the electrical wires in order to make electric contact with said wire, said terminals serving to accommodate and electrically connect tubular lamps parallel to the electrical wires.

A lighting string of the aforesaid kind is known from the U.S. Pat. No. 4,521,839 (see especially FIGS. 5–7 of the drawings accompanying said patent.

In the known lighting string the electrical wires are kept spaced from each other by an connecting band of plastic material. At the places where the lamps are to be placed a hole is cut out of said band of plastic material, and the ends of a basic part of the terminals are clinched over the electrical wires in the outer ends of the hole, whereby one of the ends is provided with a part cutting into the insulation and whereby the terminals are in electric contact with several of the electrical wires. Each terminal is furthermore provided with a centrally protruding clamping part for accommodating the connecting cap of a lamp.

The known lighting string is supposed to be accommodated in a flexible, light-transmitting tube which is closed at its ends by sealing plugs, one of said plugs having passages for the electrical wires. Thus a lighting device has been realised whereby the lighting string, fixed to a plug, is freely movable in the tube.

In the known lighting string the use of a special ribbon cable is necessary, relatively expensive terminals are needed and its manufacture is time-consuming and therefore costly.

It is noted that from said U.S. patent there is also known a lighting string in which the use of the special ribbon cable is not necessary (see FIGS. 1–3). In that case, however, mounting cylinders provided with a spring are used, which mounting cylinders must be mechanically connected to the electrical wires and whose springs must be electrically connected to the cores of the electrical wires, necessitating the difficult job of removing a small part of the insulation of the electrical wires. It will be apparent that in this case the lighting string will become even costlier, because its manufacture is even more time-consuming and the mounting cylinders will be even more expensive that the above-mentioned terminals.

Accordingly, the purpose of the present invention is to improve the known lighting string such that it can be manufactured less costly and/or that it can be used more versatilely.

SUMMARY OF THE INVENTION

For this purpose the invention provides a lighting string of the kind mentioned above, characterized in that the lighting string furthermore comprises a number of mounting blocks for accommodating respective parts of the electrical wires and respective pairs of terminals in the shape of metal plates, whereby a lower part of each terminal plate is accommodated in the respective mounting block and an upper part of each terminal plate is arranged for co-operation with a respective lamp.

The mounting blocks may have the dual function of on the one hand mounting the terminal plates, and thus the lamp, and on the other hand mounting the lighting string on a carrier. The mounting blocks preferably have a third function as well, viz. reflecting light, or put differently, preventing as much as possible that shadows are thrown. For this purpose a mounting block must be as flat as possible and it will preferably have bevelled lateral sides. The colour is chosen accordingly. The mounting blocks may be distributed over the electrical wires at the desired places or be threaded on the electrical wires, after which the placing of the terminal plates may provide the contact with the electrical wires as well as the fixation of the mounting blocks relative to the electrical wires.

The terminal plates may be cut out of a plate as a mass product, said plate having such a thickness and/or consisting of such a material that the terminal plates are slightly resilient. Also the mounting blocks, which naturally consist of an electrically insulating material, such as plastic material, can likewise be mass-produced in a simple manner, e.g. by means of an injection-moulding process. It will be apparent that the mounting blocks and the terminal plates can be manufactured simply and inexpensively, which also applies to the assembly of the eventual lighting string; by means of a special tool the terminal plates can be secured in the mounting blocks and at the same time the connection to the electrical wires may be realised.

PREFERRED EMBODIMENTS OF THE INVENTION

According to a first embodiment the lower part of each terminal plate is provided with an insulation-cutting recess and an insulation-accommodating recess.

From U.S. Pat. No. 4,525,019 (see FIGS. 1–2) there is known by itself a mounting block for accommodating respective parts of two electrical wires and respective pairs of terminals, in the shape of metal plates, whereby a lower part of each terminal plate is provided with an insulation-cutting recess. In that case, however, the terminal plate is not provided with an insulation-accommodating recess in the lower part, but with a second insulation-cutting recess, whilst a first terminal plate serves to connect one of the two electrical wires with one end of a third electrical wire and the second terminal plate serves to connect the other of the two electrical wires with one end of a fourth electrical wire, whereby said ends are also accommodated in the mounting block, just like the entire terminal plates. The main difference with the invention is therefore that the known mounting block is an electrical connector for making a double T-splice, and not a fitting for a tubular lamp, as according to the present invention.

According to a second embodiment the lower part of each terminal plate is provided with a insulation-cutting projection. In this case the two electrical wires are preferably incorporated in an electrical cable which provides insulation for both electrical wires and which has such a cross-sectional configuration that the mounting blocks, having a cable-accommodating channel, can be clamped over the cable or be put on the cable without clamping action, but with the addition of an adhesive like glue.

In this second embodiment it is to be preferred to use a method for producing a mounting block for the lighting flex which is characterized in that basic material in the shape of a mounting block is formed around two terminal plates, whilst said plates are kept correctly fixed in their position. The terminal plates will then be embedded in the mounting blocks and form one unit. It is also to be preferred to carry out said forming by means of an injection-moulding process. When a lighting string is formed with said mounting blocks having embedded terminal plates which are provided with a single efficiently pointed projection and with the above-mentioned cable according to the invention, the only operation that is necessary is either clamping the so-called integrated mounting blocks on or over the cable or pushing and adhering them on the cable. This may be done by hand as well as automatically. The pushing or clamping operation (at the same time) provides the electric contact. It may be noted that certainly in this case (second embodiment) the use of a special electrical cable has its advantages, contrary to what is the case according to the aforesaid U.S. Pat. No. 4,521,839. Indeed, the special cable according to the invention does not involve any extra operational steps, quite the contrary, it reduces their number.

The lighting string according to the invention may be applied in all kinds of lighting devices of the most diverse nature, but in particular the lighting string according to the invention is very suitable for use in display devices, such as advertising letter boxes and information display panels, such as advertising signs, traffic signs, signposts and other signalling boards, e.g. for use in the case of roadmending activities in order to call the driver's attention to these activities. When used in vessels the ship's voltage (22 V) can be used directly, i.e. without using a transformer unit.

Therefore the invention furthermore relates to a display device, comprising a box-shaped casing in the shape of an alphanumerical sign which is provided with two walls having relatively large surfaces, at least one of said walls being light-transmitting.

Such a display device is known from the U.S. Pat. No. 3,447,253.

In this known display device the box, which has the shape of an alphanumerical sign, consists of a bottom plate in the shape of a single-sided or double-sided printed circuit board and a light-transmitting cover. In the case of a single-sided printed circuit board lamps with connecting wires are soldered on the conductor tracks of the printed circuit board, whilst in the case of a double-sided printed circuit board fittings having bayonet attachments for corresponding lamps are connected to the conductor tracks on both main surfaces of the printed circuit board by means of holes in the printed circuit board. Lamps with connecting wires are vulnerable and bayonet fittings are costly, whilst the illuminating performance of such lamps in the present display device are at least questionable. All in all the known display device is costly and vulnerable and a flexible and versatile system cannot be built up with it, whilst the illuminating performance is limited and the failure on one lamp will immediately affect the illuminating quality; in the case of lamps with connecting wires replacement is furthermore time-consuming and costly.

The invention aims at removing the above disadvantages, and for that purpose provides a display device of the kind mentioned, which is characterized in that in the box-shaped casing there is fixed at least one proposed lighting string.

Said fixing may be done on the bottom plate of the box-shaped casing or on a carrier, in which latter case the display device can reflect bilateral or omnilateral light if lighting string are fixed on two sides of the carrier, respectively.

A lighting string will be provided on the bottom place or on the carrier of the box-shaped casing and/or the distance between the mounting blocks on the lighting string will be such that an optimum distribution of the lamps will be achieved; in practice it has become apparent that this can be done such, especially if the light-transmitting wall has equalizing properties, that the failure of one or even more lamps will have hardly any effect, or none at all, on the display, in particularly of the preferably coloured light output.

It is noted that the lighting string known from the aforementioned U.S. Pat. No. 4,521,839 is not suited at all for use in advertising letter boxes.

The display device according to the invention for the first time offers a real alternative for neon signs which have the following disadvantages. In the first place neon letters are operated with high voltage, which involves a potential danger, on which ground neon signs are forbidden indoors or in arcades. In the second place neon letter installations also result in the interference of alarm systems. Furthermore great lengths are out of the question, because colour deviations will occur in that case, and the purchasing costs, mounting, maintenance and repair of neon signs is costly.

The advantages of a display device according to the invention enumerated hereinabove to a certain extent also apply when the lighting string according to the invention is used in a lighting device, e.g. provided in a duct which is covered by a light-transmitting and light-equalizing plate, as a result of which a quiet and even illumination can be obtained, e.g. for the compartment-illumination in trains or the illumination in trams which are often bad and often provide a flickering, unquiet illumination when fluorescent tubes are being used. Another advantageous application is the indirect illumination in cupboards, wall units etc. These are only small indications of the enormous versatility and applicability of the present invention.

BRIEF DESCRIPTION OF THE DRAWINGS

The invention will be further discussed hereinafter with reference to the drawings, in which.

DETAILED DESCRIPTION OF THE INVENTION

Figure 1:
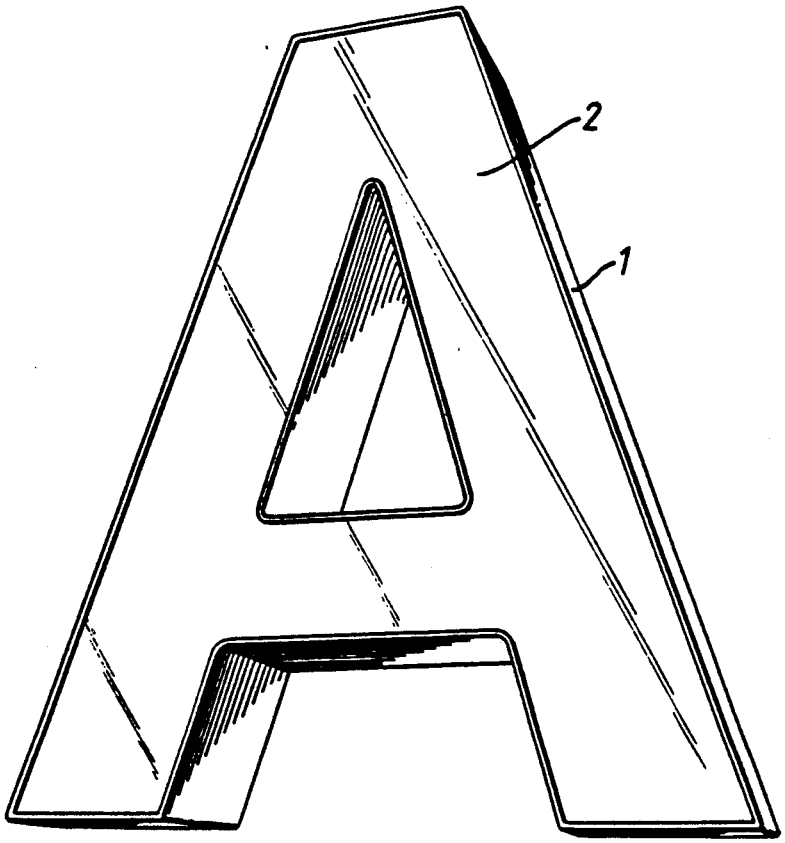
FIG. 1 is a front view of an advertising letter box, representing the capital letter A.
Figure 2:
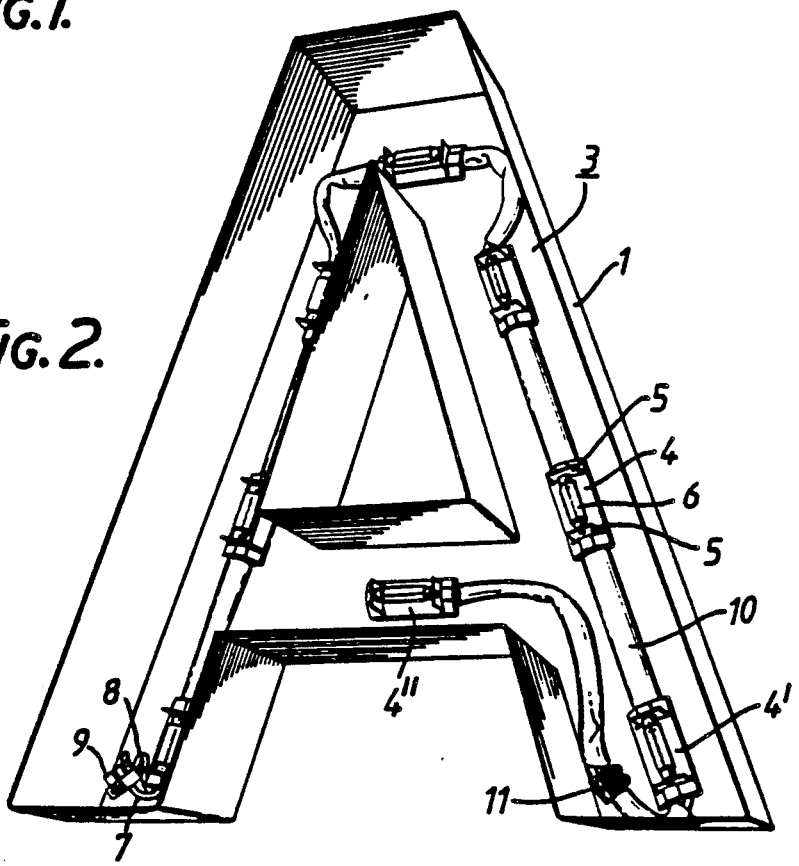
FIG. 2 is a front view of the letter box of FIG. 1, with the light-transmitting and light-equalizing front plate removed showing a piece of the lighting string according to the invention, provided with tubular lamps.

FIGS. 1 and 2 illustrate an advertising letter box in the shape of a capital letter A. In FIG. 1 the box-shaped casing 1 is closed by a light-transmitting and light-equalizing plate 2, preferably coloured, which naturally has the shape of a capital letter A too, whilst in FIG. 2 the light-transmitting plate 2 has been left out, to expose the interior of the box-shaped casing 1, as a result of which a piece of lighting string 3 according to the invention is visible, said lighting string being provided such that the three parts forming the light-transmitting plate 2 of FIG. 1 will be illuminated evenly. The advertising letter box of FIGS. 1 and 2 is arranged for emitting light to one side. Reference numeral 4 in FIG. 2 indicates a mounting block of the lighting string 3, whilst the reference numerals 5 indicate the terminal plates belonging to said mounting block 4 and the reference numeral 6 indicates a tubular lamp accommodated between said terminal plates 5 the elements 4, 5, 5 thereby comprising a lighting fixture adapted to hold a lamp 6. Reference numerals 7 and 8 indicate a first and a second insulated electrical wire, which are connected to a connector 9 in the left-hand leg of the casing 1 for connection of the lighting string 3 to a supply source, in particular a low-voltage supply source of e.g. 22 Volt. In places where no mounting blocks 4 are provided the insulated electrical wires 7 and 8 are provided with shrink sleeve 10, preferably having good light-reflecting properties, which also applies to the colour and quality of the material, e.g. plastic material, of which the mounting blocks 4 are made. The lighting string has been made in advance and the mounting blocks 4 are evenly spaced. When in that case a mounting block 4" must lie at a substantially corresponding distance from another mounting block 4, but the connecting distance to the preceding mounting block 4' is larger, a piece of lighting string 3 having larger distances between the mounting blocks 4 may be used, and be connected e.g. by means of a connector 11. When the lighting string 3 is assembled in the casing 1 itself the mounting blocks 4, 4' and 4" may be provided along the electrical wires 7, 8 at mutually different distances. The mounting blocks 4, 4' and 4" can be fixed to the bottom plate of the box-shaped casing 1 e.g. by means of rivets (pop rivets) or screws. Another possibility is the use of double sided self-adhesive tape. Also it will be possible to glue or cement the mounting blocks 4, 4' and 4" on the bottom-plate of the box-shaped casing 1. The lighting string 3 may also be fixed on two opposed sides of a carrier (not shown) and the bottom may also be a light-transmitting plate 2 (FIG. 1), which may also have another colour. Thus the advertising letter box may emit bilateral light. If also the remaining surfaces of the box-shaped casing 1 consist of a light-transmitting material an advertising letter box emitting omnilateral light can be realised. Also it will be possible to use "colourless" plates 2 and to provide the mounting blacks 4 with coloured caps (not shown) for the lamps 6.

The lighting string 3 according to the invention generally comprises two electrical wires 7, 8 extending substantially parallel to and spaced from each other and a number of pairs of terminals, or terminal plates 5 placed spaced from each other along the electrical wires 7, 8, said terminals or terminal plates being adapted to cut through the insulation of one of the electrical wires, such that an electric contact is made, and serving to accommodate and electrically parallel connect respectively tubular lamps 6, i.e. one lamp 6 for each pair of terminal plates 5. More specifically, a lower part of each terminal plate 5 is accommodated in the respective mounting block 4 and an upper part of each terminal plate 5 is arranged for co-operation with a respective lamp 6.

Figure 3:
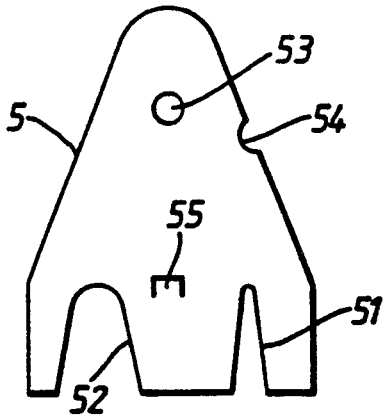
FIG. 3 is a front view of a terminal plate according to the invention.
Figure 4:
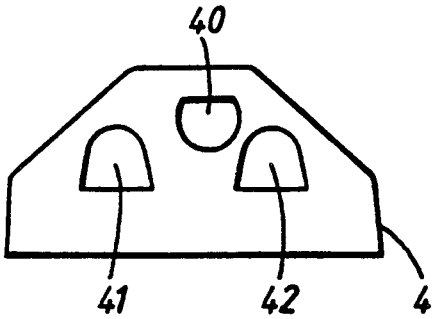
FIG. 4 is a view of the end side of a mounting block according to the invention.
Figure 5:
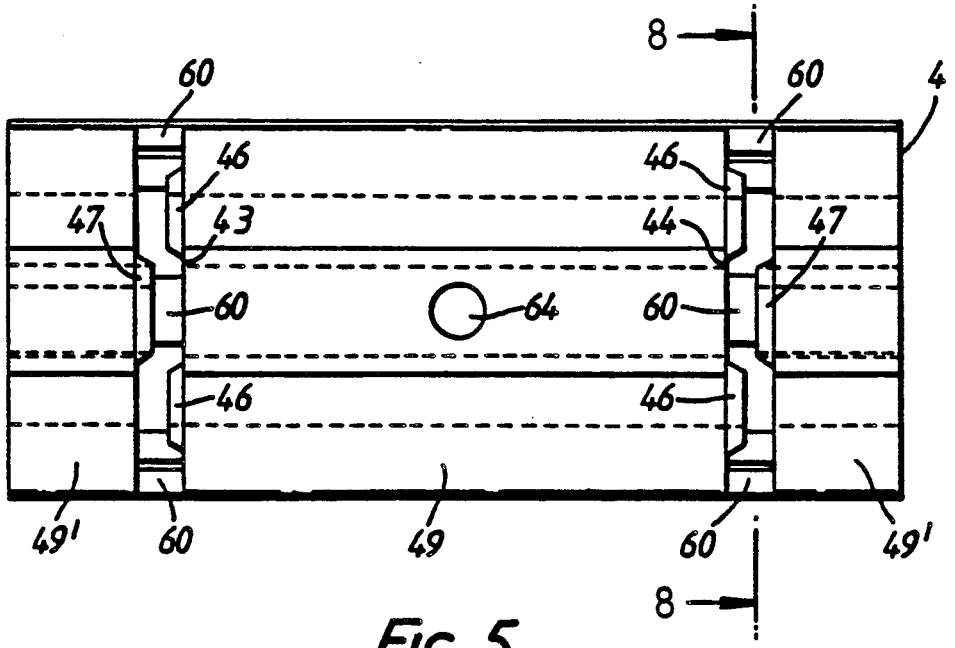
FIG. 5 is a plan view of the mounting block.
Figure 6:
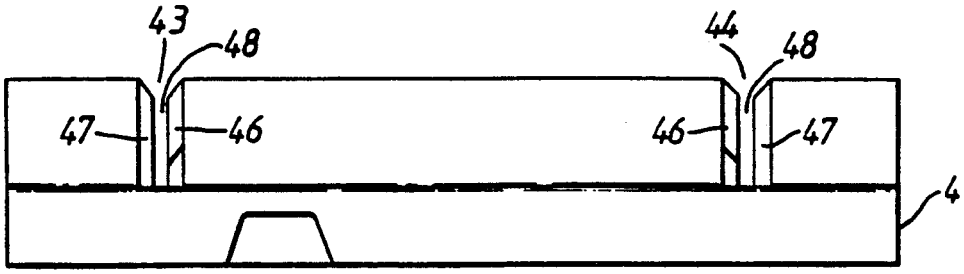
FIG. 6 is a front view of the longitudinal side of the mounting block.
Figure 7:
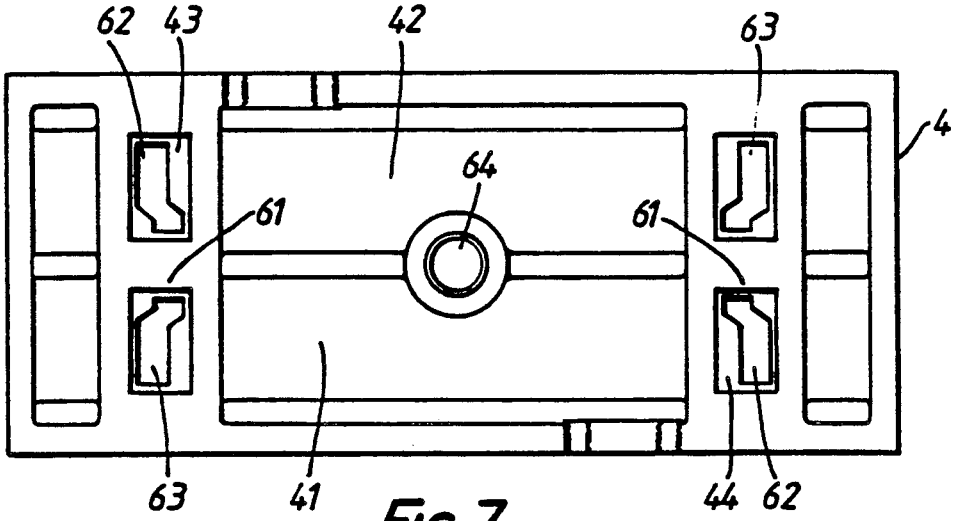
FIG. 7 is a bottom view of the mounting block.

In FIG. 3 an embodiment of a terminal plate 5 according to the present invention is illustrated in front view. Although the terminal plate 5 might be rectangular in principle, a rounded-off triangular shape has been chosen for handling reasons. The terminal plate 5 of FIG. 3 is provided with means for cutting into the insulation of one of the electrical wires to make electrical contact with said wire. As embodied, this means comprises an insulation-cutting recess 51 in the lower part of plate 5 that makes a cut in the insulation of one of the wires 7, 8 as it is pushed down or inserted into mounting block 4 as will be described in further detail below. Plate 5 also includes an insulation-accommodating recess 52 in its lower part that accommodates the other insulated wire without making a cut in its insulation. Further plate 5 is provided with means for holding and making electrical contact with lamp 6. As embodied, this means comprises a through hole 53 in the upper part of plate 5 that serves to accommodate the end of a pointed connecting cap of a lamp 6. The recess 54 serves to indicate the position of the insulation-accommodating recess 52 and consequently of that of the insulation-cutting recess 51. The lip 55, bent forward as seen from the plane of the drawing, which has been partially cut out of the terminal plate 5, serves to secure the terminal plate 5 in a mounting block 4; this will be described hereinafter.

Figure 9:
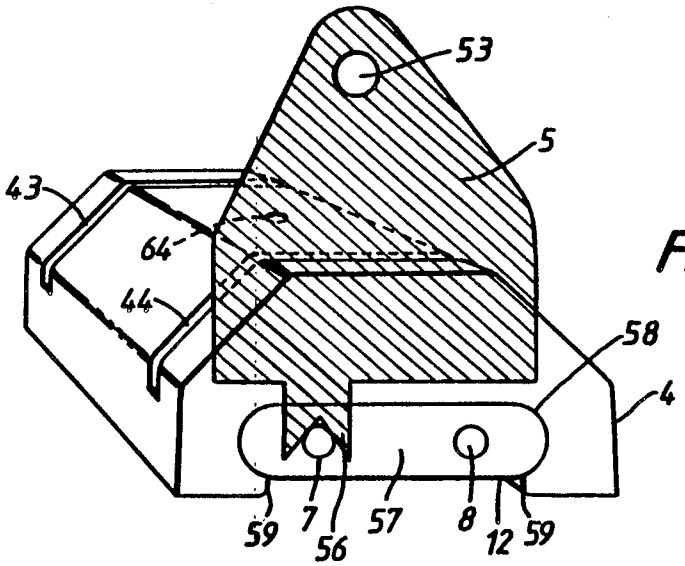
FIG. 9 is a perspective and diagrammatic view of another embodiment of the mounting block and the terminal plate according to the invention.

Another embodiment of the terminal plate 5 according to the invention is shown in FIG. 9. Here the lower part of each terminal plate 5A is provided with an insulation-cutting projection 56, which may be dovetailed, as shown. Preferably, however, the projection 56 is pointed, i.e. provided with a sharp point for making a better cut and better contact, as in this case when the separate wires of the core of the electrical wires 7, 8 are separated. The purpose remains the same, viz. to make a cut into the insulation and to make electric contact. In the embodiment illustrated in FIG. 9 the two electrical wires 7 and 8 have a common insulation 57. The insulation 57 and the electrical wires 7 and 8 form a flat electrical cable 12 which has circular ends, seen in section, the greatest width of the cable e.g. being 16 mm, its thickness being 7 mm and the centre-to-centre distance between the electrical wires 7, 8, which may e.g. consist of copper strand, being 8 mm. Although it is not shown the terminal plate 5A of FIG. 9 may also be provided with an orientation-indicating recess 54 (see FIG. 3). This also applies to the lip 55 which is shown in FIG. 3.

Figure 8:
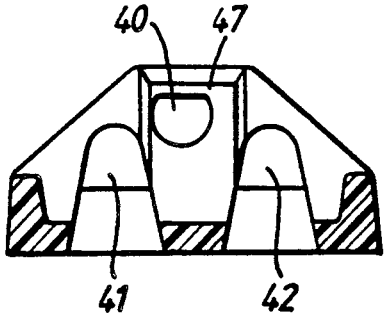
FIG. 8 is a sectional view, along the line 8—8 in FIG. 5, of a mounting block according to the invention.

Now the mounting block 4 belonging to the terminal plate 5 of FIG. 3 will be discussed. FIGS. 4–8 show that the mounting block 4 is elongated and has a substantially trapezoidal cross-section, the base side being longest. The mounting block 4 is provided with two parallel, longitudinal through channels 41, 42 for accommodating electrical wires 7, 8, the ends of said channels 41, 42 being visible in FIG. 4 and their boundaries being visible in FIG. 7. The mounting block 4 furthermore comprises two transverse slots 43 and 44 (see FIGS. 5 and 6) which serve to accommodate terminal plates 5 in positions turned 180° in relation to one another with a view to making contact with electrical wires 7, 8. The slots 43 and 44 are wider than the thickness of the terminal plates 5, but the thickenings 46 (see FIG. 5) on the one hand and always one thickening 47 on the other hand define a passage 48 which better corresponds with the thickness of the terminal plate. The slots 43 and 44 divide the mounting block 4 in a central part 49 and two end parts 49'. In the end parts 49' there is provided a through channel 40, one end of which is visible in FIG. 4 and an other end of which opens into the thickening 47, as can be seen in FIG. 8, which is a cross-section of the mounting block 4 near the slot 43, 44 and near the thickening 47. When the terminal plate 5 is inserted into the slot 43 or 44 in its correct position, i.e. with the lip 55 directed towards the thickening 47 with the channel 40, first the lip 55 will be pushed back to the plane of the terminal plate 5 and then slip into the channel 40, as a result of which the terminal plate 5 will be secured in the mounting block 4. If the terminal plate 5 is turned 180° said securing will not take place. In this latter position the terminal plate 5 will be accommodated and secured in the other slot 44 or 43, however. The terminal plate 5 can only be removed from the mounting block 4 from a secured position by providing a releasing pin in the channel 40, as a result of which the lip 55 can be pushed back into the plane of the terminal plate again. Reference number 60 indicates a stop for the bottom of the terminal plate 5, the lower side of said stop being indicated by reference numeral 61 in FIG. 7. In mounted condition, i.e. with the electrical wires 7, 8 in the channels 41, 42 and the terminal plates 5 in their correct positions, the cuts in the insulation are visible through the holes 62, whilst the holes 63 show the insulation intact. Because of the closed channels 41, 42 the mounting blocks 4 must be threaded on the electrical wires 7, 8. If the mounting blocks 4 are to be placed on the electrical wires 7, 8 it will of course be necessary for the channels 41 and 42 to be open on their bottom sides.

Now the mounting block 4 belonging to the terminal plate 5 of the type which is illustrated in FIG. 9 will be discussed. Instead of the channels 41, 42 of the embodiment in FIGS. 4–8 the mounting block 4 of FIG. 9 is provided with one large open channel 58 for accommodating the electrical cable 12 described before. The bottom side of the mounting block 4 is thereby formed at 59 such that it can be clamped on the electrical cable 12 and that it is also possible that the mounting blocks 4 are threaded on the electrical cable 12. The insulation-cutting projection 56 has the same function as the insulation-cutting recess 51 of the terminal plate of FIG. 3, whilst the insulation-accommodating recess 52 of said FIG. 3 will not be necessary in the embodiment of FIG. 9. For the rest the terminal plate 5 and the mounting block 4 of FIG. 9 may be equal to those of FIG. 3. The mounting blocks 4 are furthermore provided with a through mounting hole 64 and can be closed at their bottom side by a cover plate (not shown). Instead of the through hole 53 the terminal plates 5 may be provided with a dimple.

Although the two transverse slots 43 and 44 are diagrammatically indicated in FIG. 9 the terminal plates 5 are preferably embedded in the mounting block 4 shown in FIG. 9, so that two terminal plates 5 and a mounting block 4 belonging thereto form one single integrated unit. By clamping an integrated mounting block or lighting fixture 4 (5, 5) on or around the electrical cable 12, by hand or mechanically, the desired electric contact is automatically effected. A lighting string can therefore be made of an electrical cable 12 and integrated mounting blocks 4, after which only lamps 6 and a transformer unit (not shown in the drawing) are needed for operating the lighting string. The lamps 6 are thereby preferably operated below their nominal voltage, in order to extend their life. The integrated mounting blocks 4 can be made by forming the basic material in the shape of a mounting block around the terminal plates 5, preferably by means of an injection-moulding process, while the two terminal plates 5 are being kept correctly fixed in their positions. Keeping the plates fixed can be done in a mould, whereby the terminal plates 5 can be placed in the mould by hand, after which the injection-moulding can take place. The means and the operations required for that purpose are known to the person skilled in this field of the art.

Figure 10B:
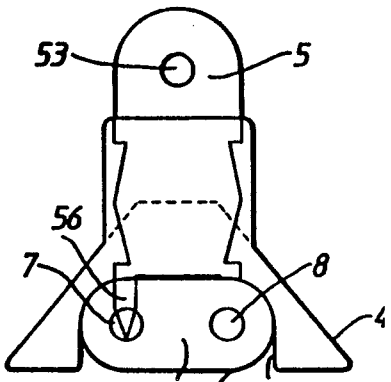
FIGS. 10A and 10B illustrate yet another embodiment of the mounting block and the terminal plate according to the invention.
Figure 10A:
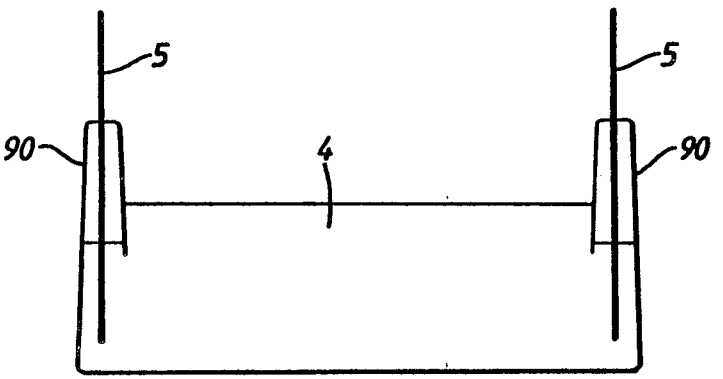

FIGS. 10A and B show an embodiment of the integrated mounting block 4 with two terminal plates 5 which is different from the one in FIG. 9. Also here the actual mounting block 4 is formed around the terminal plates 5. In so far as the integrated mounting block 4 of FIGS. 10A and B. Corresponds with the one of FIG. 9 corresponding reference numerals have been used. First the actual mounting block 4 will be described.

Just like in FIG. 9 the mounting block 4 has a substantially trapezoidal cross-section. However, the mounting block 4 only has oblique sides and its height is smaller, as a result of which the distance between the lamp 6 (not shown in the figure) and the upper side of the mounting block 4 is enlarged. Said measures improve the reflection and, partly as a result, the lighting properties.

Moreover, the channel 58 is open at its bottom side along its entire width, so that in principle the mounting block 4 can be put on and around the electrical cable 12. In particular it is necessary to push the mounting block 4 on and around the electrical cable 12, so that the projections 56 of the terminal plates 5 penetrate the respective electrical conductor 7 and 8. Contacting is therefore effected by means of said pushing operation. In this respect the method for producing the integrated mounting block 4 corresponds with the one for producing the integrated mounting block 4 according to FIG. 9. One difference is, however, that the mounting block 4 is not clamped around the electrical cable 12 but is adhered thereon by providing an adhesive between the electrical cable 12 and the channel 58 during the pushing operation. This, too, may be done mechanically. Providing the adhesive (which is not indicated in FIG. 10) may be done in various manners, e.g. providing it on the electrical cable 12 only, providing it in the channel 58, or both.

Finally the mounting block 4 is provided with two end uprights 90, which are formed around a central part of the terminal plates 5. As a result sufficient rigidity of the attachment of the terminal plates 5 is still provided, in spite of the reduced height of the main body of the mounting block 4. To a person skilled in the art it will be apparent that the configuration of the terminal plates 5 is adapted to this shape of the mounting block 4.

From the above it is apparent that the invention not only relates to a lighting string 3 and a display device, as is shown in FIGS. 1 and 2, to which embodiments the invention is not restricted for that matter, but that the invention also relates to terminal plates and to mounting blocks as such and also to a specific electrical cable.

Figure 11:
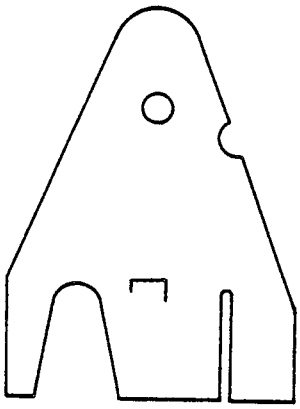
FIG. 11 is a front view of an alternative terminal plate.

Essential for the terminal plates is that they cut into a respective electrical wire and that two terminal plates can hold a tubular lamp. In principle therefore the terminal plates may be rectangular. Preferably, however, as is shown in the drawings, the lower part of the terminal plate 5 is rectangular and the upper part of the terminal plate 5 is triangular, whereby the apex angle is rounded. The terminal plate 5 is furthermore provided with an indication 54 indicating whichever insulation of the two electrical wires 7, 8 is going to be cut when the terminal plate 5 is pushed into the mounting block 4. In a rectangular terminal plate said indication may be a rounded apex angle of the terminal plate. More specifically, as shown in the drawings, said indication is a recess 54 in the side of the terminal plate 5, in particular in one of the oblique sides of the triangular upper part thereof. When two separate insulated electrical wires 7, 8 are used the rectangular lower part of the terminal plate 5 is provided with an insulation-cutting recess 51 and an insulation-accommodating recess 52 respectively. Insulation-cutting recess 51 may be rectangular as shown in FIG. 11 or triangular as shown in FIG. 3 and insulation-accommodating recess 52 is triangular, i.e. roof-shaped, and the closed ends of the recesses 51 and 52 are rounded. Alternatively, the rectangular lower part of the terminal plate 5 may be provided, according to the invention, with an insulation-cutting projection 56 which is shown in FIG. 9 and which may be dovetailed, i.e. a rectangular projection with a roof-shaped recess in its free end. In principle the terminal plate 5 of FIG. 9 may be used with two separate insulated electrical wires 7, 8, but it is more preferably used in combination with a special electrical cable 12 shown in FIG. 9 having a substantially elongated rectangular section with preferably rounded angles and consisting of an insulating material 57, in which two electrical conductors are embedded, said electrical conductors corresponding with the afore-mentioned insulated electrical wires 7, 8, whose insulation, or insulation material, is common as it were. If the tubular lamps 6 which are used are of a type with a pointed connecting cap the terminal plate 5 will preferably have a through hole 53 in its upper part for accommodating the end of an end cap of the lamp 6. Finally the terminal plate 5 is provided with a lip 55, bent from the plane of the terminal plate 5 and partially cut out of said terminal plate 5, as a result of which the terminal plate 5 can be fixed in the mounting block 4.

In principle the mounting block may be beam-shaped, comprise two through channels, closed or open at their bottom side, and be provided with two transverse slots for accommodating two terminal plates. More specifically, however, and as shown in the drawings, the cross-section of the elongated mounting rubber 4 is substantially trapezoidal, whereby the base side has the greatest length. In the lower part of the mounting block 4 there are provided, spaced from each other, two longitudinal closed channels 41, 42 for accommodating respective parts of electrical wires 7, 8. Just like the insulation-accommodating recess 52 of the terminal plate 5 the through channels 41, 42 accommodating electrical wires have a rounded triangular cross-sectional configuration. Alternatively, as already said before, a through channel 58, open at its bottom side along the greater part of its width of the mounting block 4, may be formed in the lower part of said mounting block 4 for accommodating the flat electrical cable 12 which comprises the common insulation 57 for the two electrical wires 7, 8. In particular the mounting block 4 is provided with two transverse slots 43, 44 which divide the mounting block 4 in a relatively long central part 49 and relatively short end parts 49', and which are substantially wider than the thickness of the terminal plates 5, whereby the mounting block 4 provides a stop at the bottom side of the slots for the lower part of a terminal plate 5, and whereby the central part 49 of the mounting block 4 is provided with two thickenings 46, located spaced from each other, at the oblique side and whereby the end parts 49' of the mounting block 4 are provided with a thickening 47 at the top side, so that said thickenings 46, 47 are provided staggerdly in the slots 43, 44 and define a passage 48 related to the thickness of the terminal plate 5. The end parts 49' of the mounting block 4 are provided with a longitudinal through channel 40, opening into the thickening 47 of the end parts 49', for co-operation with the lip 55 of a terminal plate 5. Finally the mounting block 4 is centrally provided with a through fixing hole 64 extending from the upper side to the lower side of the mounting block 4.

I claim:

1. A lighting string comprising two insulated electrical wires extending substantially parallel to and spaced from each other, and a plurality of lighting fixtures mounted on and spaced from each other along the length of the electrical wires and adapted to make electric contact with said wires, said fixtures serving to accommodate and electrically connect tubular lamps parallel to the electrical wires, each of said fixtures comprising a mounting block for accommodating said electrical wires and a pair of terminals for the lamps in the form of flat metal plates, the lower part of each terminal plate of each pair being accommodated in a respective mounting block in spaced relation and having means for cutting into the insulation of one of the electrical wires to make electrical contact with said wire, and the upper part of each terminal plate having means for holding and making electrical contact with a lamp.

2. The lighting string of claim 1, wherein the lower part of each terminal plate is provided with a wire insulation cutting recess and a wire insulation-accommodating recess.

3. The lighting string of claim 2, wherein the insulation-cutting recess and the insulation-accommodating recess are triangular and the closed ends of the recesses are rounded.

4. The lighting string of claim 1, wherein the lower part of each terminal plate is provided with a wire insulation-cutting projection.

5. The lighting string of claim 4, wherein the insulation-cutting projection is pointed.

6. The lighting string of claim 1, wherein the upper part of each terminal plate is provided with a through hole for making contact with lamps having pointed connecting caps on their ends.

7. The lighting string of claim 1 wherein the lower part of each terminal plate is rectangular and the upper part of each terminal plate is triangular with the apex angle being rounded.

8. The lighting string of claim 1, wherein each terminal plate has an indication which indicates whichever of the two electrical wires will be cut when the terminal plate is mounted in a mounting block.

9. The lighting string of claim 8 in which the indication is a recess in the side of the terminal plate.

10. The lighting string of claim 1, wherein each terminal plate is provided with a lip cut out from and partially bent out from the plane of the flat terminal plate.

11. The lighting string of claim 1, in which each mounting block is elongated and the cross-section of each mounting block is substantially trapezoidal with the base side having the greatest length.

12. The lighting string of claim 11, wherein each mounting block is provided at its ends with uprights for accommodating the terminal plates.

13. The lighting string, of claim 1 in which mounting block is provided in its lower part with two longitudinal closed channels, spaced from each other, for accommodating the two electrical wires.

14. The lighting string of claim 13, wherein the electrical wire accommodating channels have a rounded triangular cross-sectional configuration.

15. The lighting string of claim 1, wherein there is formed in the lower part of each mounting block a through channel, open along the larger part of the width of said channel for accommodating a flat electrical cable which comprises two electrical wires with common insulation.

16. The lighting string of claim 10, wherein each mounting block is provided with two transverse slots which divide the mounting block into a relatively long central part and two relatively short end parts, which slots are substantially wider than the thickness of the flat metal terminal plates, a stop at the bottom of each slot for receiving the lower part of each terminal plate, and two thickened portions on the central part of each block that project into said slots and are spaced from each other, and at least one thickened portion on the end parts that projects into said slots between said two thickened portions, whereby said thickened portions are provided staggerdly in the slots and define passages each approximating the thickness of a said terminal plate.

17. The lighting string of claims 16, wherein the end parts of each mounting block have a longitudinal through channel that opens into the thickened portion of the end parts of the blocks, for co-operation with the lip of a said terminal plate.

18. The lighting string of claim 1 in which each mounting block is centrally provided with a through fixing hole extending from the upper side to the lower side of the mounting block.

19. The lighting string of claim 2, wherein the insulation-cutting recess is rectangular and the insulation-accommodating recess is triangular and the closed ends of the recesses are rounded.

* * * * *